US011833842B2

(12) United States Patent
Furuyama et al.

(10) Patent No.: US 11,833,842 B2
(45) Date of Patent: Dec. 5, 2023

(54) HOLDING STAND

(71) Applicant: BROTHER KOGYO KABUSHIKI KAISHA, Nagoya (JP)

(72) Inventors: Toshiyuki Furuyama, Toyohashi (JP); Yushi Kato, Nagoya (JP); Sho Asai, Ama (JP); Takehiko Inaba, Chita (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 199 days.

(21) Appl. No.: 17/562,886

(22) Filed: Dec. 27, 2021

(65) Prior Publication Data

US 2022/0203730 A1 Jun. 30, 2022

(30) Foreign Application Priority Data

Dec. 28, 2020 (JP) ..... 2020-219181

(51) Int. Cl.

| | |
|---|---|
| ***B41J 29/06*** | (2006.01) |
| ***B41J 3/36*** | (2006.01) |
| *B41J 29/02* | (2006.01) |
| *B41J 29/04* | (2006.01) |
| *B41J 3/44* | (2006.01) |

(52) U.S. Cl.

CPC ..... *B41J 29/06* (2013.01); *B41J 3/36* (2013.01); *B41J 3/445* (2013.01); *B41J 29/02* (2013.01); *B41J 29/04* (2013.01)

(58) Field of Classification Search

CPC ..... B41J 29/06; B41J 3/36; B41J 3/445; B41J 29/02; B41J 29/04

See application file for complete search history.

(56) References Cited

U.S. PATENT DOCUMENTS

| | | | | |
|---|---|---|---|---|
| 7,306,386 | B2 * | 12/2007 | Lyman | B41J 3/36 400/692 |
| 9,848,692 | B1 * | 12/2017 | Kato | B41J 3/36 |
| 2004/0150368 | A1 * | 8/2004 | Horigome | H02J 7/0048 320/132 |
| 2016/0236493 | A1 * | 8/2016 | Lyman | H01R 33/7664 |
| 2020/0171862 | A1 | 6/2020 | Sanada et al. | |

FOREIGN PATENT DOCUMENTS

| | | | |
|---|---|---|---|
| JP | 2020-82647 | A | 6/2020 |

* cited by examiner

*Primary Examiner* — Henok D Legesse

(74) *Attorney, Agent, or Firm* — KENEALY VAIDYA LLP

(57) ABSTRACT

A holding stand including: a housing having a mounting surface on which a printing device is capable of being detachably mounted and a bottom surface, the mounting surface being an inclined surface where a distance between an upstream end portion of the mounting surface and the bottom surface is greater than a distance between a downstream end portion of the mounting surface and the bottom surface; a fixed engaging member provided at the upstream end portion; a movable engaging member provided at a substantially middle portion of the mounting surface; a guide part provided on the mounting surface and configured to allow the printing device to slide thereon to guide the printing device; and an operation part capable of switching the movable engaging member from an engaging position in which the movable engaging member engages with a second engaging portion to a disengaging position in which engagement is disengaged.

6 Claims, 10 Drawing Sheets

HOLDING STAND

CROSS-REFERENCE TO RELATED APPLICATIONS

This application is based upon and claims the benefit of priority from prior Japanese patent application No. 2020-219181, filed on Dec. 28, 2020, the entire contents of which are incorporated herein by reference.

TECHNICAL FIELD

The present disclosure relates to a holding stand for holding a printing device.

BACKGROUND ART

A holding stand for holding a printing device is known. For example, a holding stand on which a printing device is capable of being mounted is disclosed by related-art. A base part of the holding stand on which the printing device is mounted has a substantially flat plate shape. In addition, the holding stand is provided with an engaging portion to which the mounted printing device is engaged. Thereby, the printing device can be held on the holding stand. Further, by disengaging the engagement, the printing device can be separated from the holding stand.

In the holding stand of the related art, an upper surface of the base part has a substantially planar surface shape and extends horizontally. As for the printing device that is mounted on the upper surface, in many cases, an operation panel unit (including a display screen, an operation button and the like) is provided on a front surface-side of the printing device. In this case, for example, in a state where the holding stand is installed on a substantially horizontal installation surface and the printing device is mounted on the holding stand, it is difficult for the operation panel unit to be in a users view. For this reason, it is difficult for the user to see the display screen and to operate the operation button.

SUMMARY

An aspect of the present disclosure provides a holding stand enabling a display screen of a printing device to be easily seen and an operation button of the printing device to be easily operated in a state where the printing device is mounted on the holding stand.

According to an aspect of the present disclosure, there is provided a holding stand including: a housing having a mounting surface on which a printing device is capable of being detachably mounted and a bottom surface on an opposite side to the mounting surface, a direction orthogonal to the mounting surface being defined as a first direction and a direction orthogonal to the first direction being defined as a second direction, and the mounting surface forming an inclined surface where a distance between an upstream end portion of the mounting surface on upstream in the second direction and the bottom surface is greater than a distance between a downstream end portion of the mounting surface on downstream in the second direction and the bottom surface; a fixed engaging member provided at the upstream end portion of the mounting surface and configured to engage with a first engaging portion located in a first position of the printing device; a movable engaging member provided at a substantially middle portion in the second direction of the mounting surface and configured to engage with a second engaging portion located in a second position of the printing device; a guide part provided on the mounting surface and configured to allow the printing device to be mounted on the mounting surface to slide thereon to guide the printing device in the second direction; and an operation part configured to switch the movable engaging member from an engaging position in which the movable engaging member engages with the second engaging portion to a disengaging position in which engagement between the movable engaging member and the second engaging portion is disengaged.

In the holding stand of the above-described aspect, the housing has the mounting surface on which the printing device is capable of being mounted, and the bottom surface. The fixing engaging member is provided at the upstream end portion of the mounting surface on upstream in the second direction, and the movable engaging member is provided at the substantially middle portion of the mounting surface in the second direction. In a case where the printing device is mounted on the mounting surface, the fixed engaging member is engaged with the first engaging portion of the printing device and the movable engaging member is engaged with the second engaging portion of the printing device. By the engagement by the first engaging portion and the engagement by the second engaging portion, it is possible to stably hold the printing device on the holding stand.

When separating the held printing device, the movable engaging member is operated via the operation part. When the operation part is operated, the movable engaging member is switched from the engaging position to the disengaging position, so that the engagement by the second engaging portion is disengaged. By disengaging the engagement, the printing device can be easily separated from the holding stand.

The mounting surface is an inclined surface. When mounting the printing device, the printing device is guided by the guide part provided on the mounting surface. The guide part is configured to allow the printing device to be mounted on the mounting surface inclined as described above to slide thereon to guide the printing device in the second direction. Thereby, the user can smoothly mount the printing device.

The mounting surface is the inclined surface where the distance between the upstream end portion of the mounting surface on upstream in the second direction and the bottom surface is greater than the distance between the downstream end portion of the mounting surface on downstream in the second direction and the bottom surface. Thereby, for example, when the holding stand is installed on the substantially horizontal installation surface, the upstream end portion on upstream in the second direction of the mounting surface becomes higher than the downstream end portion on downstream in the second direction. Since the printing device is mounted on such mounting surface, the printing device can be held in such an inclined manner where the downstream end portion in the second direction is higher. Specifically, in a case where the printing device is mounted in such a posture that the operation panel unit provided for the printing device faces downstream of the holding stand in the second direction, a position of the operation panel unit from the installation surface can be made high. Thereby, the user can easily see the display screen provided for the operation panel unit, so that the user can easily operate the operation button provided for the operation panel unit.

By the above configuration, according to the aspect of the present disclosure, in the state where the printing device is mounted on the holding stand, it is possible to enable the display screen of the printing device to be easily seen and the operation button to be easily operated.

According to another aspect of the present disclosure, there is provided the printing device configured to be detachably mounted to the holding stand according to the above-described aspect, the printing device including: a printer main body having a substantially cuboid shape; and an operation panel unit including a display screen and an operation button, the operation panel unit being arranged on an end face on one side of the printer main body, wherein in a state where the printing device is mounted on the holding stand installed on an installation surface, the operation panel unit is in a posture of facing upward obliquely by a predetermined angle with respect to the installation surface.

DESCRIPTION OF EMBODIMENTS

Hereinafter, an embodiment of the present disclosure will be described with reference to the drawings.

Figure 1:
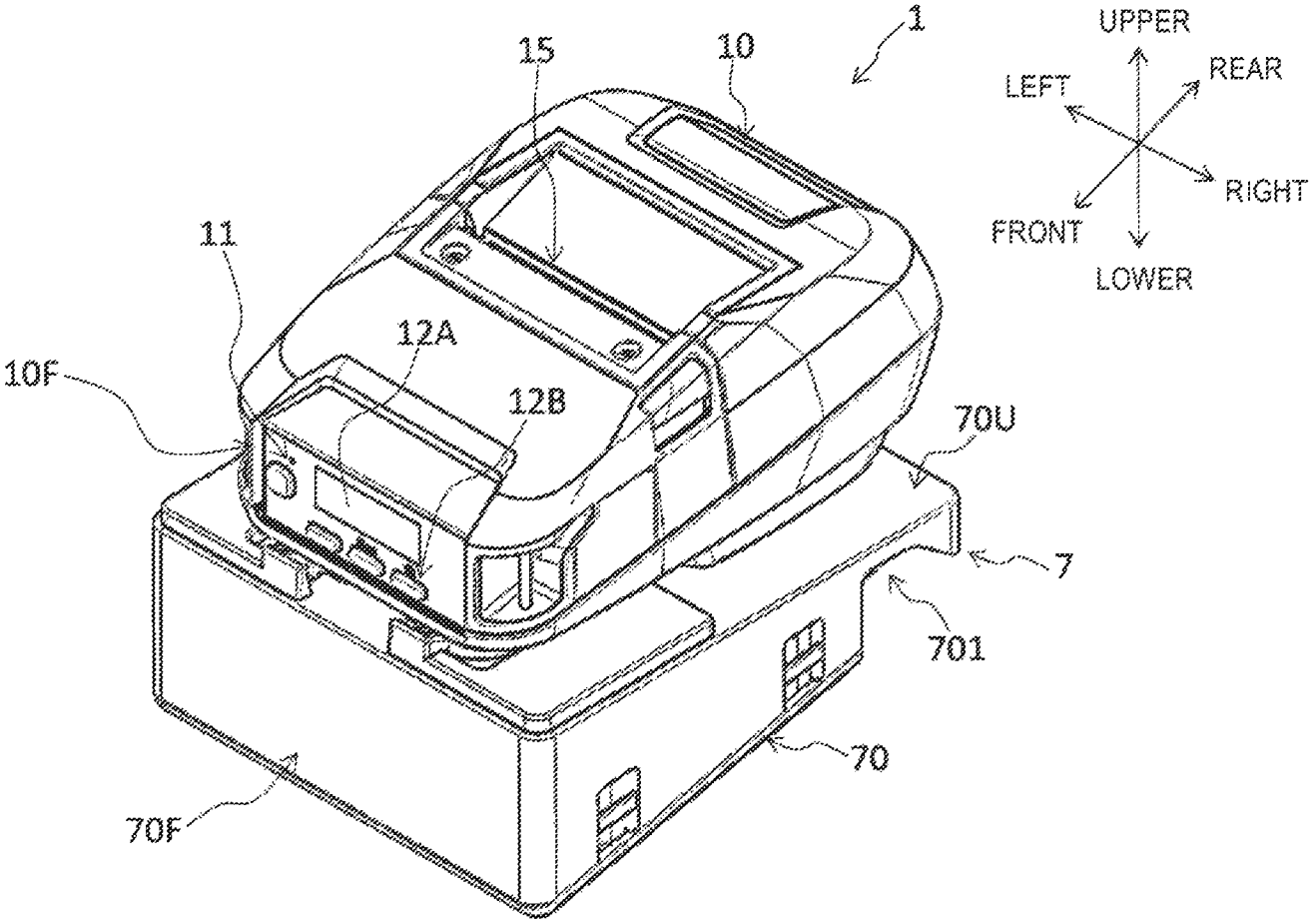
FIG. 1 is a perspective view of a printing device and a holding stand.

As shown in FIG. 1, a printing device 1 is detachably mounted on a holding stand 7. The holding stand 7 will be described in detail later. The printing device 1 is a mobile heat-sensitive printer that can be driven by a battery 5 (refer to FIG. 3). The printing device 1 can connect to an external terminal (not shown) by wired or wireless communication. The printing device 1 can print characters such as letters, figures and the like on a heat-sensitive label by causing an internal thermal head (not shown) to generate heat based on print data received from the external terminal. The external terminal is a general-purpose personal computer (PC). The printing device 1 is carried and used by a user by being mounted to a waist belt via a belt clip (not shown) or by being put on a shoulder via a shoulder belt (not shown). The holding stand 7 is a stationary stand that can hold the printing device 1. When the printing device 1 having the battery 5 mounted thereon is held on the holding stand 7, the holding stand 7 also functions as a charging stand that can charge the battery 5. Even in a state of being held on the holding stand 7, the printing device 1 can execute a printing operation by a user operation. Note that, in the description below, the upper and lower direction, the front and rear direction and the right and left direction correspond to the upper and lower direction, the fore and back direction and the right and left direction as seen from the user, as shown in each drawing.

<Printing Device>

Figure 2:
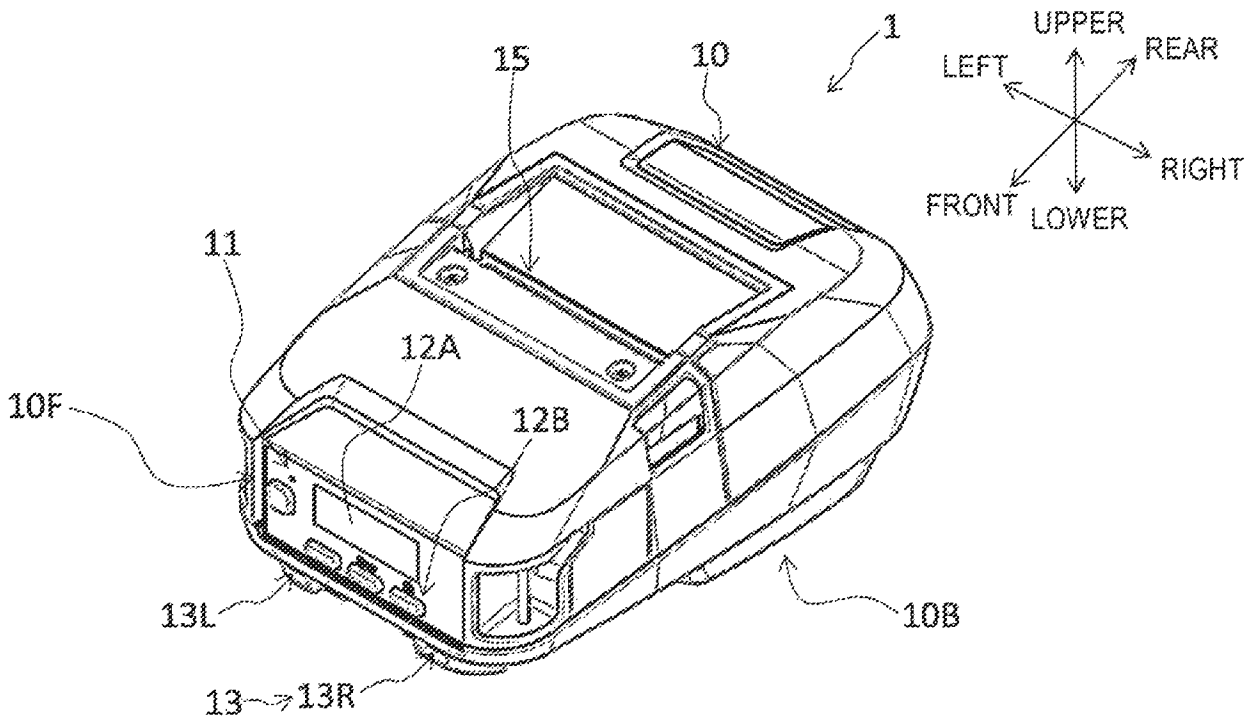
FIG. 2 is a perspective view of the printing device, as seen from above.
Figure 3:
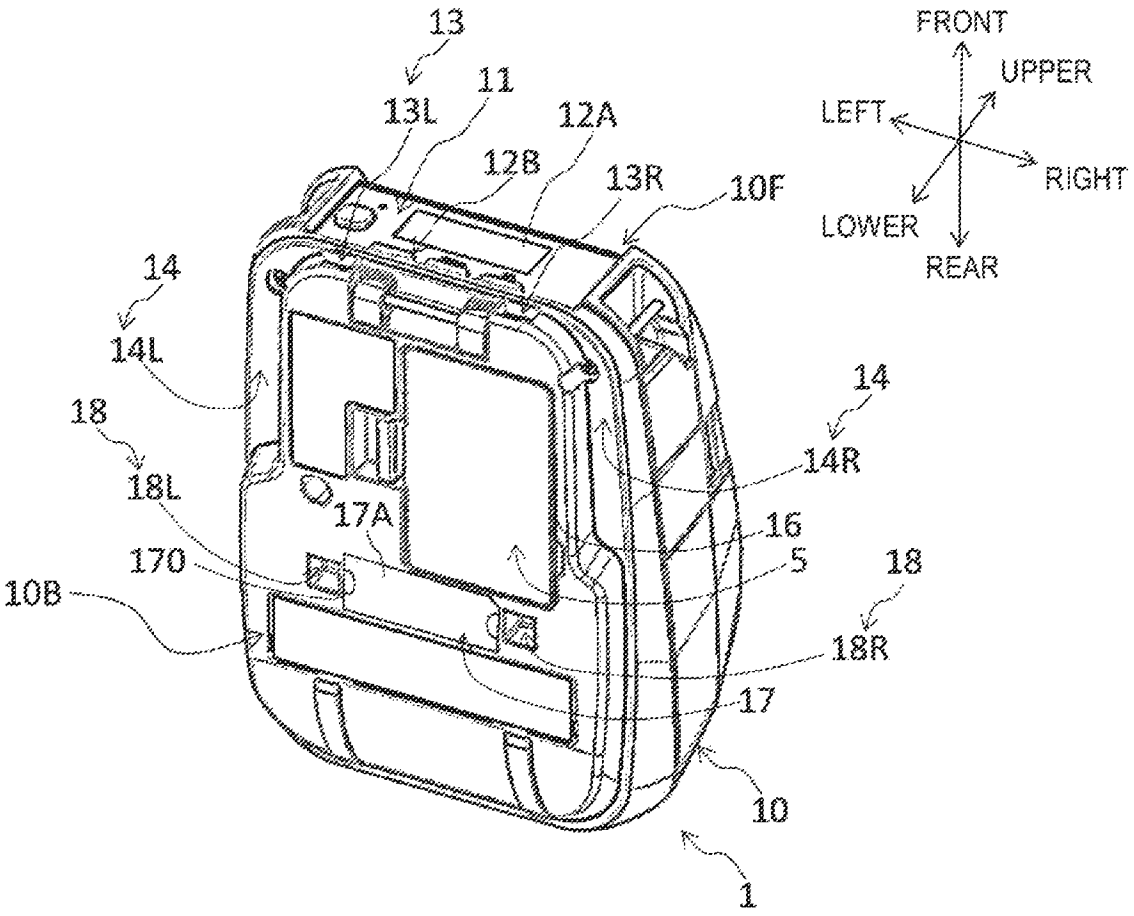
FIG. 3 is a perspective view of the printing device, as seen from below.

As shown in FIGS. 2 and 3, the printing device 1 includes a printer main body 10 having a substantially cuboid shape. A user interface 11 (which corresponds to the operation panel unit) is provided at a part of a front surface 10F of the printer main body 10, other than both left and right end portions. The user interface 11 includes a Liquid Crystal Display (LCD) 12A (which corresponds to the display screen) and a plurality of operation buttons 12B. Based on visual recognition of the LCD 12A by the user, an operation on the operation button 12B by the user, and the like, a printing operation is executed. As shown in FIG. 2, first engaging portions 13L and 13R are aligned with a space therebetween in the right and left direction at a front end of the printer main body 10 and in positions on a lower side of the front surface 10F with respect to the user interface 11. The first engaging portions 13L and 13R are collectively referred to as "first engaging portion 13". The first engaging portion 13 is a concave portion that is concave rearward. An opening portion of the first engaging portion 13 has a rectangular shape. The position in which the first engaging portion 13 is provided is referred to as "first position".

A lower surface 10B of the printer main body 10 is a surface corresponding to a mounting surface 70U of the holding stand 7, which will be described later. As shown in FIG. 3, a concave portion 14L is provided at a left end on a more outer side than the first engaging portion 13L. The concave portion 14L is a concave portion that is concave upward from the lower surface 10B along the left end of the lower surface 10B, and extends rearward from the front end of the lower surface 10B. In addition, a concave portion 14R is provided at a right end on a more outer side than the first engaging portion 13R. The concave portion 14R is a concave portion that is concave upward from the lower surface 10B along the right end of the lower surface 10B, and extends rearward from the front end of the lower surface 10B. The concave portions 14L and 14R are collectively referred to as "concave portion 14".

As shown in FIG. 2, an upper surface 10U of the printer main body 10 is provided with a discharge port 15 through which a printed heat-sensitive label is discharged.

As shown in FIG. 3, the lower surface 10B of the printer main body 10 is provided with an accommodation part 16. The accommodation part 16 is a concave part that is concave upward. In the accommodation part 16, the battery 5 can be accommodated. FIG. 3 shows a state where the battery 5 is accommodated in the accommodation part 16. The battery 5 has a substantially cuboid shape, which is substantially the same as an internal shape of the accommodation part 16. In the state where the battery 5 is accommodated in the accommodation part 16, positions of the lower surface 10B of the printer main body 10 and a lower surface of the battery 5 in the upper and lower direction are the same. For this reason, the lower surface 10B of the printer main body 10 and the lower surface of the battery 5 are planes that are flush with each other.

In the state where the battery 5 is accommodated in the accommodation part 16, terminals (not shown) provided to each of the battery 5 and the accommodation part 16 are in contact with each other. The battery 5 is configured to supply DC electric power to the printing device 1 via the terminals in contact with each other. The printing device 1 is configured to drive by the DC electric power supplied from the battery 5, thereby executing a printing operation. In addition, in a case where the printing device 1 having the battery 5 mounted thereto is held on the holding stand 7 (refer to FIG. 1), the battery 5 can be charged by electric power that is supplied from the holding stand 7.

As shown in FIG. 3, a device-side terminal 17 is provided in a concave part 170 formed on a rear side of the lower surface 10B with respect to the accommodation part 16. The device-side terminal 17 includes a plurality of electrodes aligned in the right and left direction. In FIG. 3, the concave part 170 is closed by a cover 17A. When the cover 17A is detached, the device-side terminal 17 is exposed. The printing device 1 is held on the holding stand 7 in a state where the cover 17A is detached.

A second engaging portion 18L is provided in a position on a left side of the lower surface 10B with respect to the device-side terminal 17. A second engaging portion 18R is provided in a position on a right side of the lower surface 10B with respect to the device-side terminal 17. The second engaging portions 18L and 18R are collectively referred to as "second engaging portion 18". The second engaging portion 18 is a concave portion that is concave upward. An opening portion of the second engaging portion 18 has a rectangular shape. The position in which the second engaging portion 18 is provided is referred to as "second position".

<Holding Stand>

Figure 4:
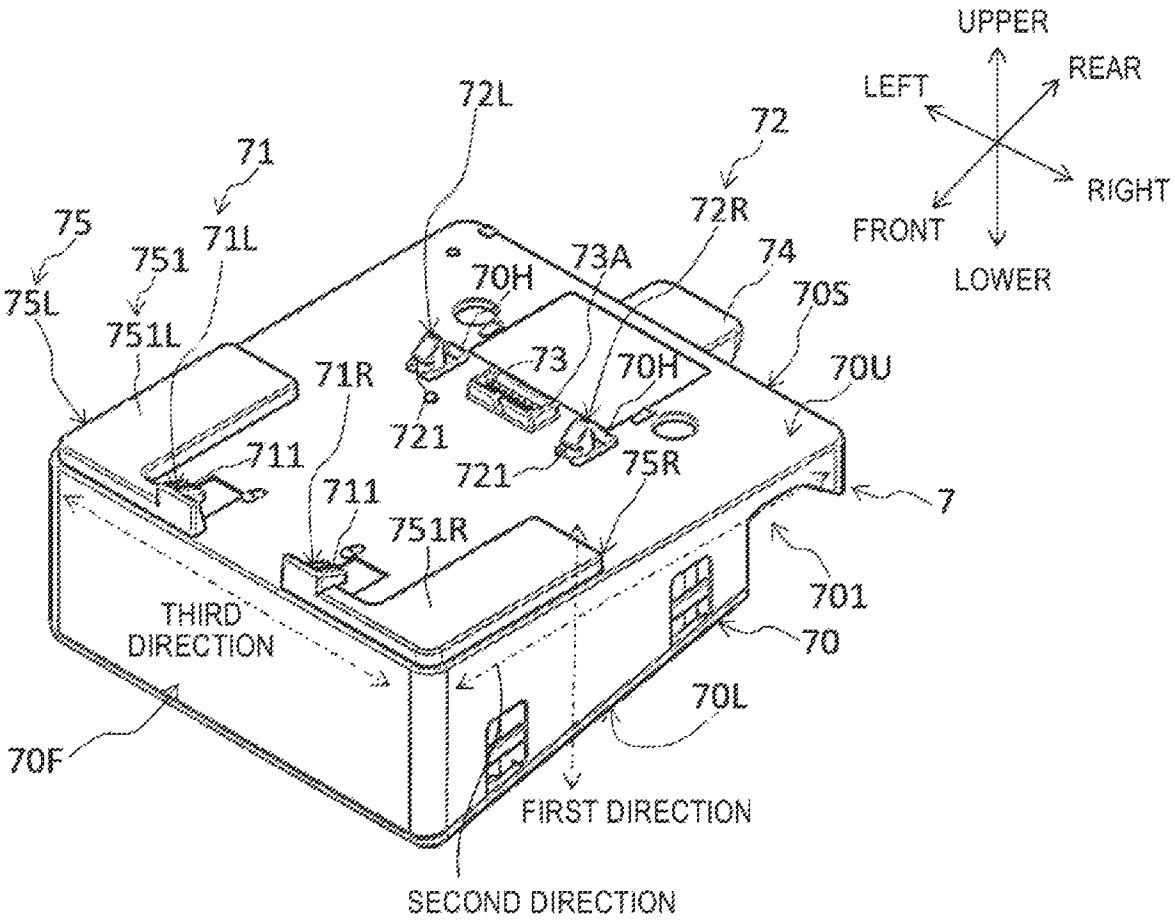
FIG. 4 is a perspective view of the holding stand according to an embodiment of the present disclosure, as seen from above.
Figure 5:
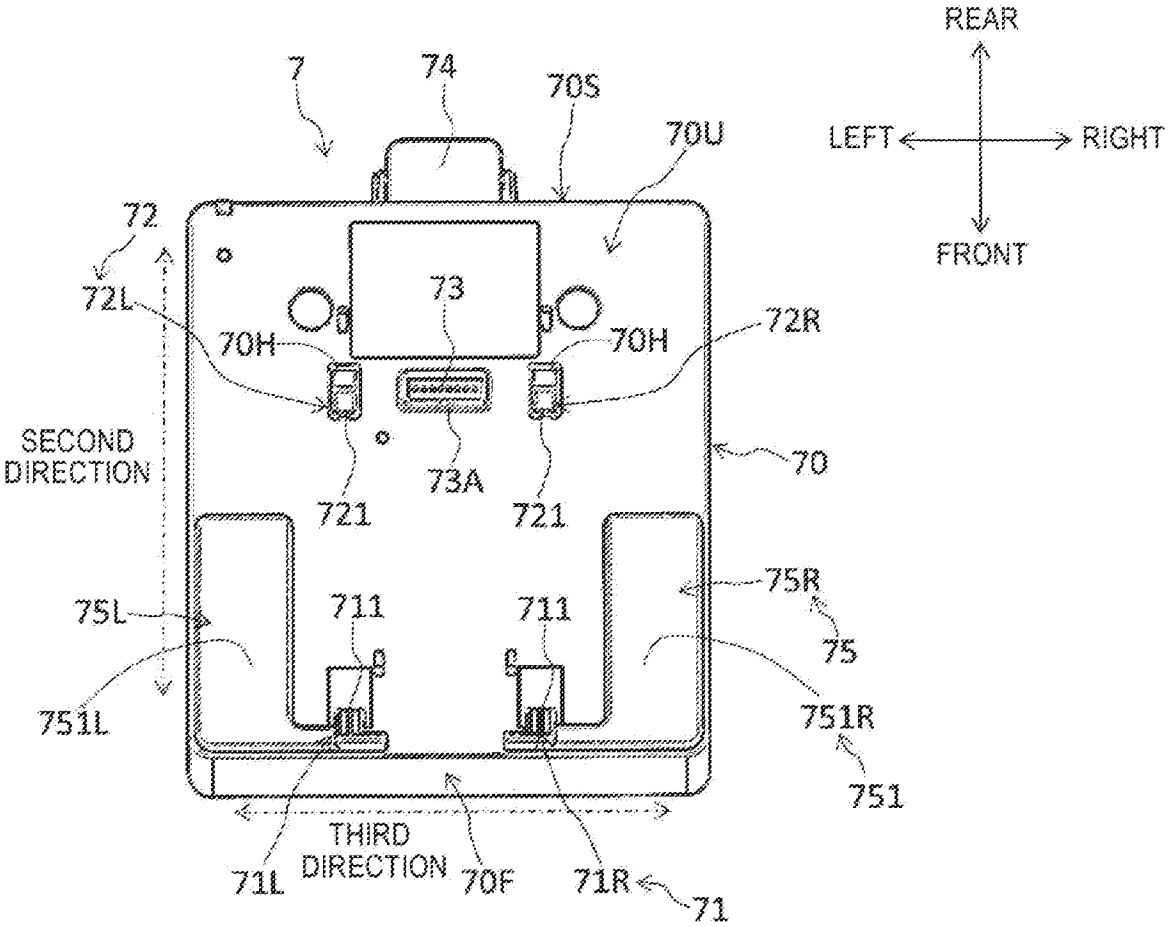
FIG. 5 is a plan view of the holding stand.
Figure 6:
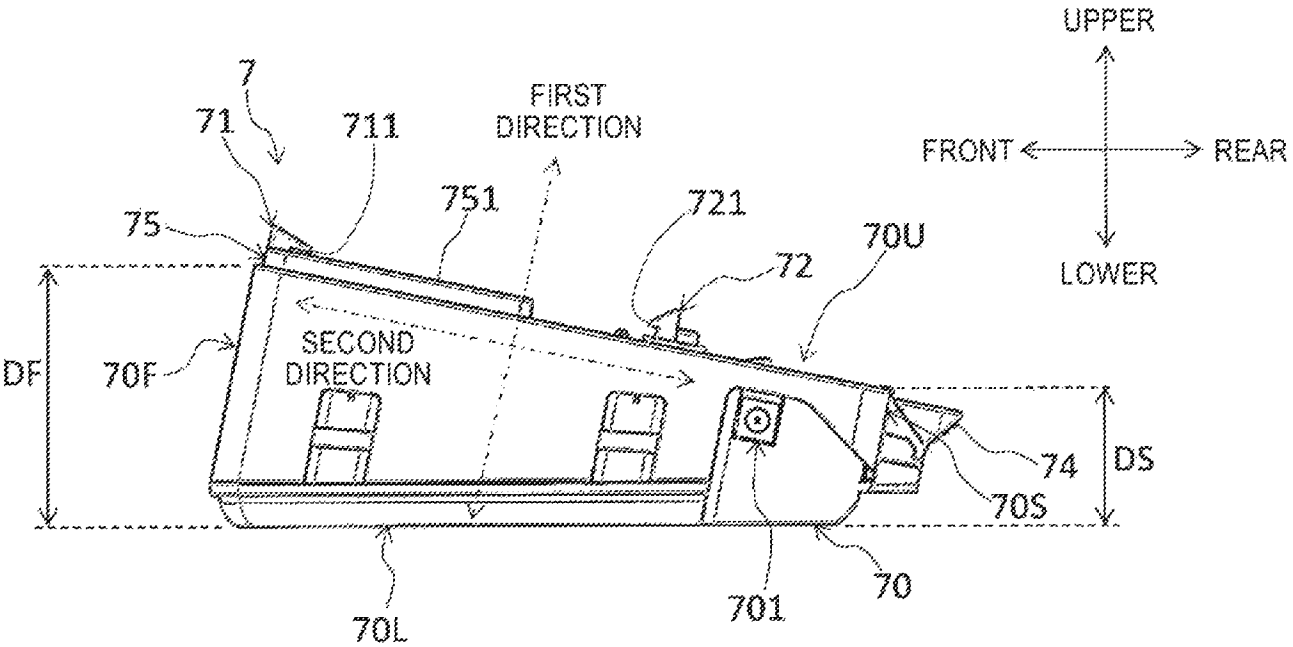
FIG. 6 is a side view of the holding stand, as seen from the right side.

As shown in FIGS. 4 to 6, the holding stand 7 includes a housing 70 having a substantially box-shape as a whole. Amounting surface 70U for mounting the printing device 1 is provided on an upper side of the housing 70. The mounting surface 70U has a substantially rectangular shape, as seen from above, and is inclined relative to a bottom surface 70L by a predetermined angle. For the housing 70, a first direction, a second direction and a third direction are each defined. The first direction is a direction orthogonal to the inclined mounting surface 70U. The second direction is a direction along the mounting surface 70U and is orthogonal to the first direction. The third direction is a direction orthogonal to both the first direction and the second direction, and corresponds to the right and left direction in the drawings.

As shown in FIG. 6, as for the mounting surface 70U, a distance DF between the bottom surface 70L and the mounting surface 70U at an end portion of the housing 70 on a front oblique upper side in the second direction is greater than a distance DS between the bottom surface 70L and the mounting surface 70U at an end portion of the housing 70 on a rear oblique lower side in the second direction. That is, the mounting surface 70U is an inclined surface that is inclined upward toward the front.

As shown in FIG. 4, fixed engaging members 71L and 71R are aligned with a space therebetween in the right and left direction at an end of the mounting surface 70U on the front oblique upper side in the second direction. The engaging members 71L and 71R are collectively referred to as "engaging member 71". The engaging member 71 protrudes obliquely, upward and rearward, from the mounting surface 70U along the first direction. As shown in FIG. 6, the engaging member 71 is a fixed hook having an L-shape, as seen from a side. An upper surface of the engaging member 71 is inclined relative to the mounting surface 70U and faces upward and rearward. A tip end of the engaging member 71 is provided with a bent portion 711 bent obliquely, downward and rearward, along the second direction. The bent portion 711 is introduced from the opening of the first engaging portion 13 of the printing device 1, so that the engaging member 71 can be engaged to the first engaging portion 13.

As shown in FIG. 5, a rectangular hole 70H is provided at a substantially middle portion of the mounting surface 70U in the second direction and on a rear and lower side with respect to the engaging member 71 in the second direction. As shown in FIG. 4, in the hole 70H on the rear and lower side with respect to the engaging member 71L, a movable engaging member 72L extends from a front and lower side toward a rear and upper side along the first direction. In the hole 70H on the rear oblique lower side with respect to the engaging member 71R, a movable engaging member 72R extends from a front oblique lower side toward a rear oblique upper side along the first direction. The engaging members 72L and 72R are aligned with a space therebetween in the right and left direction. The engaging members 72L and 72R are collectively referred to as "engaging member 72". The engaging member 72 has a substantially quadrangular prism shape.

The engaging member 72 protrudes obliquely, upward and rearward, from the mounting surface 70U along the first direction. As shown in FIG. 6, the engaging member 72 is a movable hook having an L-shape, as seen from a side. An upper surface of the engaging member 72 is inclined relative to the mounting surface 70U and faces upward and forward. A tip end of the engaging member 72 is provided with a bent portion 721 bent obliquely, upward and forward, along the second direction. The bent portion 721 is introduced from the opening of the second engaging portion 18 of the printing device 1, so that the engaging member 72 can be engaged to the second engaging portion 18. The bent portion 711 at the tip end of the engaging member 71, which is a fixed hook, and the bent portion 721 at the tip end of the engaging member 72, which is a movable hook, are arranged to face each other in the second direction.

A lower end portion of the engaging member 72 is supported to be movable in the second direction in the housing 70. Specifically, the engaging member 72 can move relative to the housing 70 in the second direction. The engaging member 72 is switched in position between an "engaging position" shown in FIG. 6 and a "disengaging position" shown in FIG. 7. The engaging member 72 is urged from the disengaging position toward the engaging position by a spring (not shown) provided in the housing 70.

As shown in FIGS. 4 and 5, a stand-side terminal 73 is provided at a part of the mounting surface 70U between the holes 70H through which the engaging members 72L and 72R each pass. The stand-side terminal 73 has a plurality of electrodes. The plurality of electrodes is applied with a voltage V in a state where a jack of an AC adapter is connected to a socket 701 (refer to FIGS. 6 and 7). A wall portion 73A has a plate shape, and extends upward and rearward from a position of the mounting surface 70U surrounding the stand-side terminal 73. A part of a front end portion of the wall portion 73A is cut to form an opening portion.

A lever 74 (which corresponds to the operation part) is provided on a rear surface 70S of the housing 70. The lever 74 is supported in a manner that a rear end portion of the lever 74 can move upward by a support shaft (not shown) which is provided in the housing 70 and extending in the third direction (right and left direction). The lever 74 is coupled to the lower end portion of the engaging member 72 via a link member (not shown) provided in the housing 70.

Figure 7:
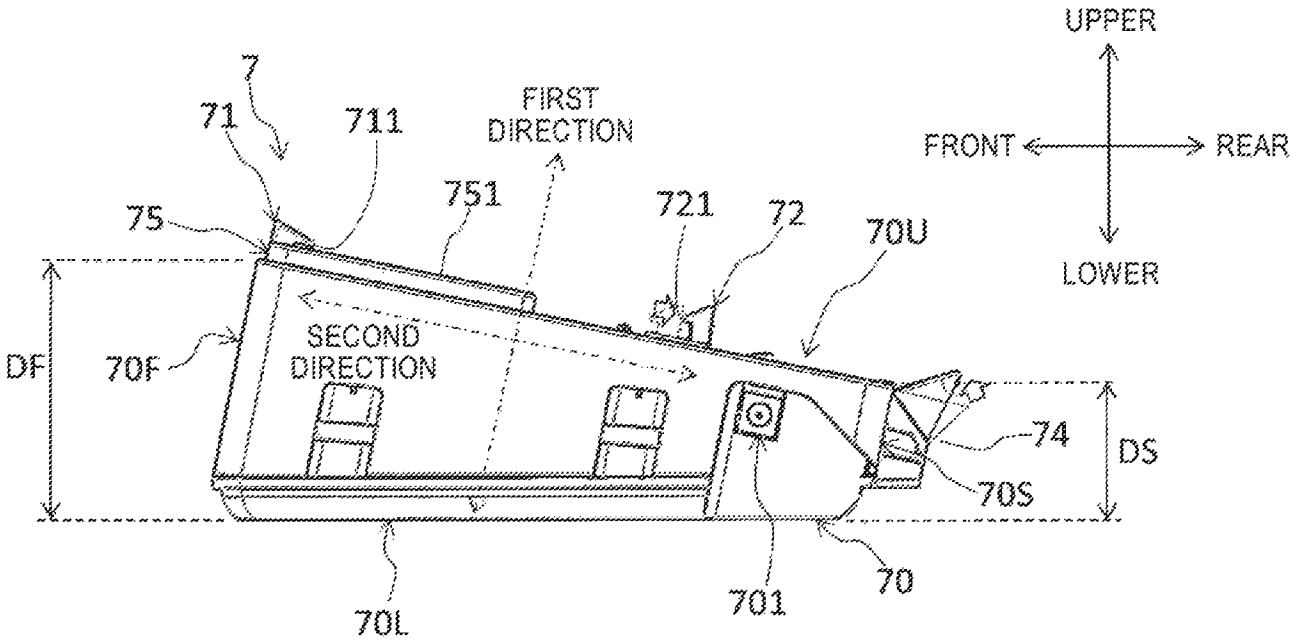
FIG. 7 is a side view of the holding stand, as seen from the right side, in a state where a movable engaging member is located in a disengaging position.

As shown in FIG. 7, when the lever 74 is operated so that the rear end portion of the lever 74 moves upward, the link member operates, so that the lower end portion of the engaging member 72 moves obliquely, downward and rearward, in the second direction. Specifically, the engaging member 72 moves from the engaging position toward the disengaging position against an urging force of the spring in the housing 70. In this way, the lever 74 can be switched from the engaging position in which the movable engaging member 72 is engaged to the second engaging portion 18 to the disengaging position in which the engagement is disengaged.

As shown in FIGS. 4 and 5, a guide part 75L is provided in a position of the mounting surface 70U on a left side of the engaging member 71L in the third direction. The guide part 75L has a convex portion 751L having a substantially cuboid shape. One corner of the guide part 75L overlaps a corner on a left front side of the mounting surface 70U, and a long side of the guide part 75L overlaps a left end of the mounting surface 70U. The guide part 75L extends from a further front upper side than the engaging member 72L in the second direction toward a front upper side along the second direction, and extends to the front end of the mounting surface 70U. A guide part 75R is provided in a position of the mounting surface 70U on a right side of the engaging member 71R in the third direction. The guide part 75R has a convex portion 751R having a substantially cuboid shape. One corner of the guide part 75R overlaps a corner on a right front side of the mounting surface 70U, and a long side of the guide part 75R overlaps a right end of the mounting surface 70U. The guide part 75R extends from a further front upper side than the engaging member 72R in the second direction toward a front upper side along the second direction, and extends to the front end of the mounting surface 70U. The guide parts 75L and 75R are collectively referred to as "guide part 75". The convex portions 751L and 751R are collectively referred to as "convex portion 751". As shown in FIG. 6, the convex portion 751 protrudes upward obliquely rearward from the mounting surface 70U along the first direction. The convex portion 751 is configured to be engageable with the concave portion 14 of the printer main body 10. When mounting the printing device 1 on the mounting surface 70U, the guide part 75 allows the printing device 1 to slide thereon to guide the printing device 1 in the second direction.

Figure 8:
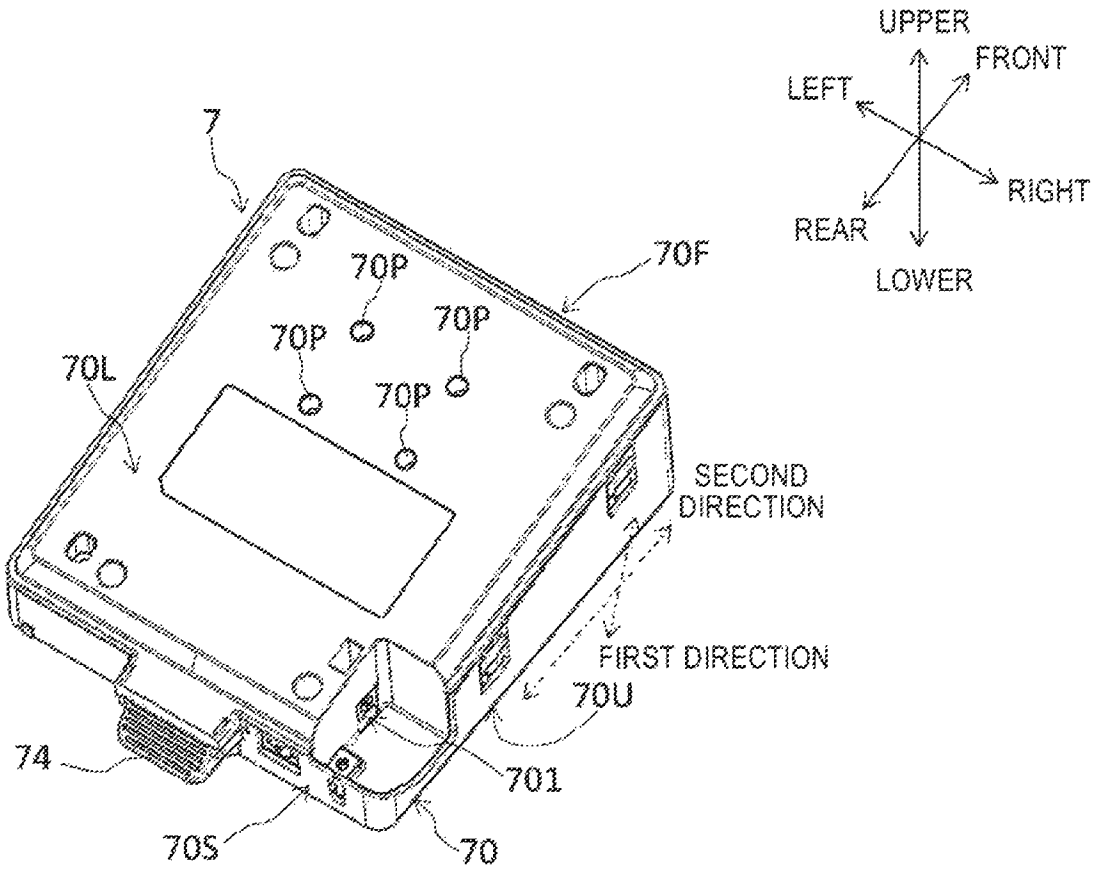
FIG. 8 is a perspective view of the holding stand, as seen from below.

As shown in FIG. 8, circular holes 70P (which corresponds to the attaching portion) are provided in the bottom surface 70L, which is a surface on a front lower side in the first direction, of the housing 70. When using the housing 70 in a wall-mounted style, the housing 70 is mounted on a wall via the holes 70P so that the bottom surface 70L faces a wall surface. Thereby, the front surface 70F of the housing 70 is held in a downward-facing posture (refer to FIG. 10).

<Method of Holding Printing Device on Holding Stand>

The printing device 1 in which the cover 17A (refer to FIG. 3) is detached and the device-side terminal 17 is exposed is arranged on an upper side with respect to the holding stand 7 (refer to FIG. 4). As the printing device 1 moves obliquely, downward and forward, with respect to the holding stand 7, the printing device 1 comes close to the holding stand 7. A front end of the concave portion 14 of the printing device 1 comes into contact with the convex portion 751 of the holding stand 7 and then the printing device 1 moves obliquely, upward and forward, while sliding on the mounting surface 70U. At this time, the concave portion 14 is engaged with the convex portion 751, and the guide part 75 allows the printing device 1 to slide thereon to guide the printing device 1 in the second direction. As shown in FIG. 1, the bent portion 711 of the engaging member 71 of the holding stand 7 is introduced into the first engaging portion 13 of the printing device 1 from the front side. Thereby, the engaging member 71 of the holding stand 7 is engaged to the first engaging portion 13 of the printing device 1, so that the front end portion of the printing device 1 is held on the holding stand 7.

Then, a downward force is applied to the rear end portion of the printing device 1. The rear end portion of the printing device 1 comes close to the holding stand 7. An opening end of the second engaging portion 18 (refer to FIG. 3) of the printing device 1 comes into contact with the upper surface of the engaging member 72 (refer to FIGS. 4 and 6). Since the upper surface of the engaging member 72 is inclined, a rearward force is applied from the opening end of the second engaging portion 18 to an upper end portion of the engaging member 72. The engaging member 72 moves obliquely, upward and rearward, in the second direction and moves from the engaging position to the disengaging position against the urging force of the spring in the housing 70 (refer to FIG. 7). The rear end portion of the printing device 1 comes closer to the holding stand 7, so that the bent portion 721 of the engaging member 72 of the holding stand 7 is introduced into the second engaging portion 18 of the printing device 1. The rearward force becomes not applied to the engaging member 72. The engaging member 72 moves from the disengaging position to the engaging position by the urging force of the spring in the housing 70 (refer to FIG. 6). Thereby, the engaging member 72 of the holding stand 7 is engaged to the second engaging portion 18 of the printing device 1, so that the rear end portion of the printing device 1 is held on the holding stand 7. By the above, the printing device 1 is mounted on the mounting surface 70U of the housing 70 (refer to FIG. 1).

When the printing device 1 is mounted on the mounting surface 70U, the battery 5 is electrically connected to the stand-side terminal 73 of the holding stand 7 via the device-side terminal 17 of the printing device 1. Note that, in a state where the jack of the AC adapter is connected to the socket 701 of the holding stand 7, the voltage V that can charge the battery 5 is applied to the electrodes of the stand-side terminal 73. For this reason, the voltage V is applied to the battery 5 mounted to the printing device 1 via the stand-side terminal 73 and the device-side terminal 17. Therefore, the battery 5 is charged.

Figure 9:
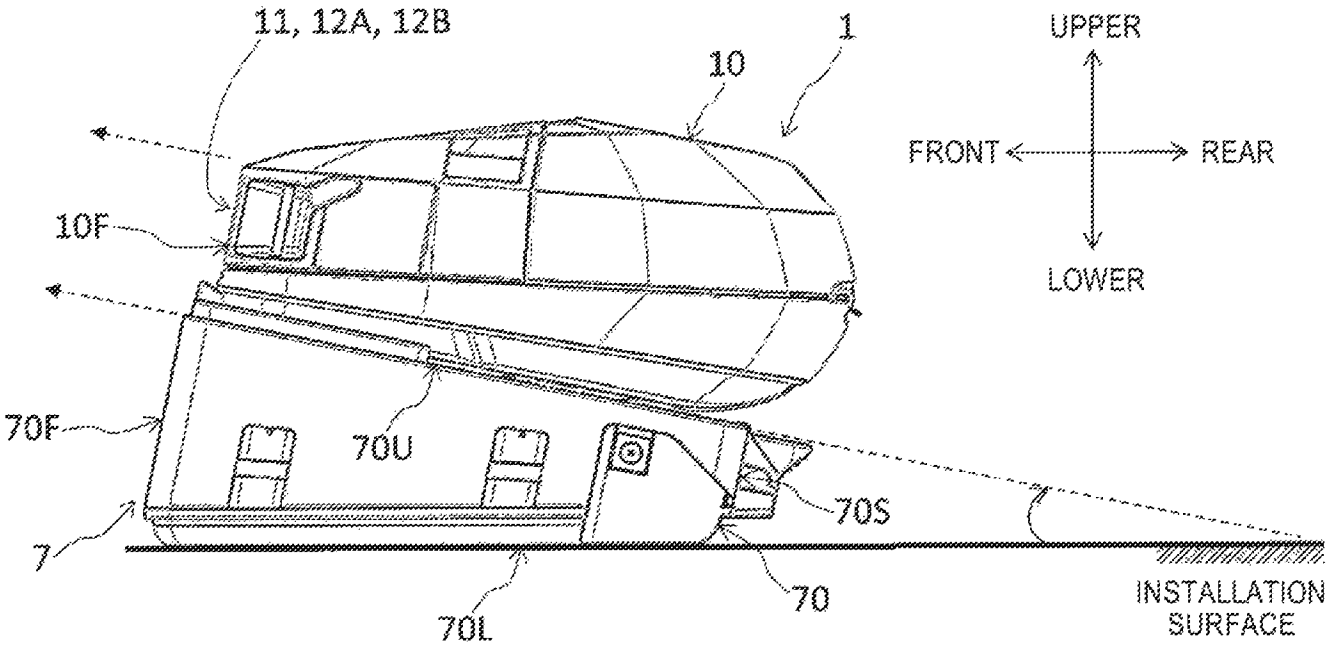
FIG. 9 is a side view of the printing device and the holding stand, as seen from the right side, in a state where the printing device is mounted on the holding stand in a case where a housing of the holding stand is installed on a horizontal installation surface.
Figure 10:
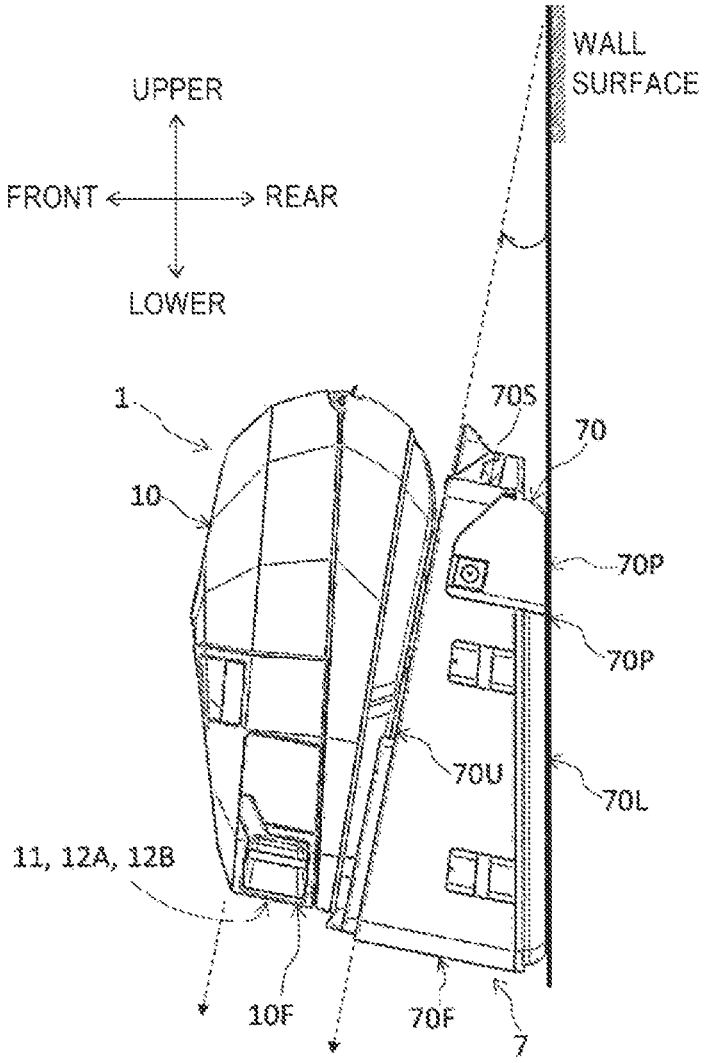
FIG. 10 is a side view of the printing device and the holding stand, as seen from the right side, in a state where the printing device is mounted on the holding stand in a case where the housing of the holding stand is used in a wall-mounted style.

The mounting surface 70U is inclined relative to the horizontal surface by a predetermined angle. As shown in FIG. 9, in a case where the holding stand 7 is installed on a substantially horizontal installation surface, i.e., in a case where the bottom surface 70L of the housing 70 is installed on a substantially horizontal installation surface, the user interface 11 on the front surface 10F is in a posture facing upward obliquely by a predetermined angle with respect to the horizontal surface in a state where the printing device 1 is mounted on the holding stand 7. In addition, as shown in FIG. 10, in a case where the holding stand 7 is used in a wall-mounted style via the hole 70P, i.e., in a case where the bottom surface 70L of the housing 70 is installed facing the wall surface (for example, a surface substantially vertical to the substantially horizontal installation surface), the user interface 11 on the front surface 10F is in a posture facing forward obliquely by a predetermined angle with respect to the wall surface in a state where the printing device 1 is mounted on the holding stand 7. In the state where the printing device 1 is held on the holding stand 7, it is possible to execute a printing operation by visual recognition of the LCD 12A by the user, an operation on the operation buttons 12B, and drive of the battery 5.

<Method of Separating Printing Device from Holding Stand>

When the lever 74 is operated in the state where the printing device 1 is held on the holding stand 7, the engaging member 72 of the holding stand 7 moves from the engaging position to the disengaging position (refer to FIG. 7). Thereby, the engaged state of the engaging member 72 of the holding stand 7 with the second engaging portion 18 of the printing device 1 is disengaged. Then, an upward force is applied to the rear end portion of the printing device 1. The engaging member 72 of the holding stand 7 is separated from the second engaging portion 18 of the printing device 1, and the rear end portion of the printing device 1 moves upward. Then, the printing device 1 moves obliquely, upward and rearward. Thereby, the engaged state of the engaging member 71 of the holding stand 7 with the first engaging portion 13 of the printing device 1 is disengaged. In addition, the engaged state of the convex portion 751 of the holding stand 7 with the concave portion 14 of the printing device 1 is also disengaged. By the above, the printing device 1 is separated from the holding stand 7.

Effects of Embodiment

As described above, according to the holding stand 7 of the present embodiment, the mounting surface 70U is provided on the rear upper side of the housing 70 in the first direction. The printing device 1 is mounted on the mounting surface 70U. The fixed engaging member 71 is provided at the end portion on the front upper side of the mounting surface 70U in the second direction, and the movable engaging member 72 is provided at the substantially middle portion of the mounting surface 70U in the second direction. During the mounting, the engaging member 71 is engaged with the first engaging portion 13 of the printing device 1 and the engaging member 72 is engaged with the second engaging portion 18 of the printing device 1. By the engagement by the first engaging portion 13 and the engagement by the second engaging portion 18, it is possible to stably hold the printing device 1 on the holding stand 7.

When separating the held printing device 1, the engaging member 72 is operated via the lever 74. When the lever 74 is operated, the engaging member 72 is switched from the engaging position to the disengaging position, so that the engagement by the second engaging portion 18 is disengaged. By disengaging the engagement, it is possible to easily separate the printing device 1 from the holding stand 7.

The mounting surface 70U is an inclined surface. When mounting the printing device 1, the printing device 1 is guided by the guide part 75 provided on the mounting surface 70U. The guide part 75 is configured to allow the printing device 1 to be mounted on the mounting surface 70U inclined as described above to slide thereon to guide the printing device 1 in the second direction. Thereby, the user can smoothly mount the printing device 1.

The distance DF between the mounting surface 70U on the front upper side in the second direction and the bottom surface 70L of the housing 70 is greater than the distance DS between the mounting surface 70U on the rear oblique lower side in the second direction and the bottom surface 70L of the housing 70. Thereby, for example, when the holding stand 7 is installed on the substantially horizontal installation surface, the end portion of the mounting surface 70U on the front upper side in the second direction becomes higher than the end portion on the rear lower side in the second direction. Therefore, the holding stand 7 can mount the printing device 1 on the mounting surface 70U to hold the printing device 1 in a manner of being inclined so that the front upper side in the second direction is higher. Thereby, since the position of the user interface 11 of the printing device 1 becomes high, the user can easily see the LCD 12A provided for the user interface 11 and easily operate the operation buttons 12B provided for the user interface 11.

By the above configuration, according to the present disclosure, it is possible to enable the LCD 12A of the printing device 1 to be easily seen and the operation buttons 12B to be easily operated.

In addition, in the present embodiment, particularly, the lower surface 10B of the printing device 1, which is a surface corresponding to the mounting surface 70U, is provided with the concave portion 14, and the guide part 75 has the concave portion 751 that is engaged with the concave portion 14. Thereby, when mounting the printing device 1 on the mounting surface 70U, it is possible to smoothly guide the printing device 1 by concave and convex engagement with the holding stand 7.

Further, in the present embodiment, particularly, the fixed hook is used as the fixed engaging member 71, and the movable hook is used as the movable engaging member 72. The fixed hook and the movable hook each have an L-shape, as seen from a side. The fixed hook and the movable hook are arranged so that the bent portions 711 and 721 at the tip ends thereof face each other in the second direction. According to this configuration, the hooks are used as the fixed and movable engaging members 71 and 72, and the tip ends of the hooks face each other. Thereby, it is possible to stably and firmly hold the mounted printing device 1.

Further, in the present embodiment, particularly, as shown in FIG. 10, the holding stand 7 can be used in a posture where the front surface 70F of the housing 70 faces downward, i.e., a so-called wall-mounted style. The bottom surface 70L of the housing 70 of the holding stand 7 is provided with the holes 70P. By the holes 70P, the housing 70 is held in the posture where the front surface 70F of the housing 70 faces downward. By the above-described structure of the mounting surface 70U, when the holding stand 70 is used in a wall-mounted style, a part on the front lower side (i.e., a part on the lower side) of the mounting surface 70U in the second direction is located in front of a part on the rear upper side (i.e., a part on the upper side) in the second direction. Specifically, when using the holding stand 70 in a wall-mounted style, the user interface 11 of the printing device 1 is located on a fore side close to the user. Thereby, even when using the holding stand 70 in a wall-mounted style, the user can easily see the LCD 12A of the user interface 11 and easily operate the operation buttons 12B of the user interface 11.

Further, in the present embodiment, particularly, the printing device 1 includes the printer main body 10 and the user interface 11. The user interface 11 includes the LCD 12A and the operation buttons 12B. As shown in FIG. 9, by installing the holding stand 7 on the substantially horizontal installation surface, the end portion of the mounting surface 70U on the front upper side in the second direction becomes higher than the end portion of the mounting surface 70U on the rear lower side in the second direction. The printing device 1 is mounted on the mounting surface 70U inclined in this way, so that a posture of the user interface 11 faces upward obliquely by a predetermined angle with respect to the horizontal surface. As a result, the user can easily see the LCD 12A and easily operate the operation buttons 12B.

Modified Embodiments

The present disclosure is not limited to the above-described embodiment, and can be modified in various manners. In the above embodiment, the surface of the printing device 1, which corresponds to the mounting surface 70U, is provided with the concave portion 14, and the guide part 75 of the holding stand 7 has the convex portion 751 that engages with the concave portion 14. Instead of this, the surface of the printing device 1, which corresponds to the mounting surface 70U, may be provided with a convex portion, and the guide part 75 of the holding stand 7 may have a concave portion that engages with the convex portion. Also with this configuration, when mounting the printing device 1 on the mounting surface 70U, it is possible to smoothly guide the printing device 1 by concave and convex engagement with the holding stand 7.

Note that, in the above descriptions, when the terms "same", "equivalent", and "different" are used in the context of dimensions or sizes of external appearance, these terms does not necessarily mean "same", "equivalent", and "different", respectively, in a strict sense. Specifically, the terms "same", "equivalent", and "different" allows design-related and production-related tolerance and error to be taken into consideration, and mean "substantially same", "substantially equivalent", and "substantially different", respectively.

Also, other than mentioned above, the methods of the above embodiment and each of the modified embodiments may be appropriately combined for use.

Although not specifically exemplified, the present disclosure is put into practice with various changes made within a range not departing from the spirit of the present disclosure.

What is claimed is:

1. A holding stand comprising:

a housing having a mounting surface on which a printing device is capable of being detachably mounted and a bottom surface on an opposite side to the mounting surface, a direction orthogonal to the mounting surface being defined as a first direction and a direction orthogonal to the first direction being defined as a second direction, and the mounting surface being an inclined surface where a distance between an upstream end portion of the mounting surface on upstream in the second direction and the bottom surface is greater than a distance between a downstream end portion of the mounting surface on downstream in the second direction and the bottom surface;

a fixed engaging member provided at the upstream end portion of the mounting surface and configured to engage with a first engaging portion located in a first position of the printing device;

a movable engaging member provided at a substantially middle portion of the mounting surface in the second direction and configured to engage with a second engaging portion located in a second position of the printing device;

a guide part provided on the mounting surface and configured to allow the printing device to be mounted on the mounting surface to slide thereon to guide the printing device in the second direction; and an operation part configured to switch the movable engaging member from an engaging position in which the movable engaging member engages with the second engaging portion to a disengaging position in which engagement between the movable engaging member and the second engaging portion is disengaged.

2. The holding stand according to claim 1, wherein the housing has a periphery, and wherein the guide part is provided to extend from a position to the upstream end portion, the position being closer to the periphery in a third direction orthogonal to the first direction and the second direction than the movable engaging member, and the position being further upstream of the movable engaging member in the second direction.

3. The holding stand according to claim 1, wherein the guide part has a convex portion configured to engage with a concave portion provided on a surface of the printing device, the surface corresponding to the mounting surface, or the guide part has a concave portion configured to engage with a convex portion provided on the surface of the printing device, the surface corresponding to the mounting surface.

4. The holding stand according to claim 1, wherein the fixed engaging member includes a fixed hook having a bent portion bent into a substantially L-shape, wherein the movable engaging member includes a movable hook having a bent portion bent into a substantially L-shape, and wherein the bent portion of the fixed hook and the bent portion of the movable hook are arranged to face each other in the second direction.

5. The holding stand according to claim 1, wherein the bottom surface has an attaching portion, the attaching portion being configured to allow the holding stand to be held in a posture where an upstream portion of the housing in the second direction faces downward.

6. A printing device configured to be detachably mounted to the holding stand according to claim 1, the printing device comprising:

a printer main body having a substantially cuboid shape; and an operation panel unit including a display screen and an operation button, the operation panel unit being arranged on an end face on one side of the printer main body, wherein in a state where the printing device is mounted on the holding stand installed on an installation surface, the operation panel unit is in a posture of facing upward obliquely by a predetermined angle with respect to the installation surface.

* * * * *